US007227067B2

(12) United States Patent
Tarpinian

(10) Patent No.: US 7,227,067 B2
(45) Date of Patent: Jun. 5, 2007

(54) TARPIN, A STRING MUSICAL INSTRUMENT

(76) Inventor: Ardashes Tarpinian, 5708 Mammoth Ave., Van Nuys, CA (US) 91401

( * ) Notice: Subject to any disclaimer, the term of this patent is extended or adjusted under 35 U.S.C. 154(b) by 174 days.

(21) Appl. No.: 10/687,889

(22) Filed: Oct. 20, 2003

(65) Prior Publication Data

US 2005/0081698 A1 Apr. 21, 2005

(51) Int. Cl.
*G10D 3/00* (2006.01)

(52) U.S. Cl. ..... 84/291; 84/267

(58) Field of Classification Search ..... 84/291, 84/267, 297 R, 299, 300, 301
See application file for complete search history.

(56) References Cited

U.S. PATENT DOCUMENTS 474,120 A * 5/1892 Ganss ..... 84/267
508,543 A * 11/1893 Hay ..... 84/267
529,893 A * 11/1894 Burke ..... 84/291
964,660 A * 7/1910 Laurian ..... 84/263
1,304,914 A * 5/1919 Smith ..... 84/291

* cited by examiner

*Primary Examiner*—Kimberly Lockett
(74) *Attorney, Agent, or Firm*—Joseph Farzam Law Firm; Joseph S. Farzam

(57) ABSTRACT

A string musical instrument having a body with a hole in the center for sound resonance, an upper bridge at the top and a lower bridge at the bottom. There is a plurality of long frets connected with the top of the body directly below the upper bridge whereby the frets are distanced so as to produce sounds that are a half note apart. There is also a plurality of tuning boxes attached to the bottom of the body, which are used to tune the instrument. There is further a plurality of strings, running through the upper and lower bridge secured from the top on the back of the body and from the bottom to the tuning box. A performer holds the instrument with the bottom on his lap and places one hand on the top over the upper bridge with fingers projected over the frets to change the pitch and with the fingers of the other free hand plucks the string to produce music.

16 Claims, 15 Drawing Sheets

TARPIN, A STRING MUSICAL INSTRUMENT

BACKGROUND (1) Technical Field

The present invention relates to the field of musical instruments, and more particularly to Tarpin, a string musical instrument.

(2) Discussion

String musical instruments have been well known in the art for thousands of years. One such instrument was Lyre. Over 3000 B.C. in Greece, Egypt, Samaria, Rome and Armenia Lyre was quite popular.

A lyre is a stringed musical instrument, in which two arms jut out on one side of the instrument's body and at their tips support a yoke or crossbar to which gut strings are attached. The strings run to the body, across the belly or soundboard, over a bridge, and to a stringholder at the lower end of the belly. In box lyres, the body and belly form a hollow wooden box; in bowl lyres, the body may be a tortoise shell or carved bowl, and the belly is of animal skin.

Box lyres with asymmetrical arms were known in ancient Sumeria by 2800 BC; this western Asian lyre was also played in ancient Egypt, as was a smaller symmetrical lyre. Lyres were extremely popular in Greece and were associated with the god Apollo. Two main varieties were made. The kithara, played by professional musicians was a box lyre with thick, symmetrical, hollow arms; it was plucked with a plectrum, or pick. The lyra, played by amateurs and plucked with the fingers, was a bowl lyre, typically a tortoise shell with a belly of bull's hide.

The kinnor of the ancient Hebrews, the instrument of King David, was like the kithara. In modern times similar lyres, with or without a bridge, are played in East Africa. They include the Beganna, which was also like the kithara, and the lyra-like krar, both of Ethiopia. In African and ancient lyres the strings are wound around the crossbar and tightened by adjusting the windings or by inserting small wooden wedges in the windings. The left-hand fingers typically damp the unwanted strings, while the right-hand fingers sweep across all the strings, either directly or with a plectrum. In the Middle Ages box lyres were widely used in northern Europe until about AD 1000. These lyres usually had crossbars carved of the same piece of wood as the body and arms; they also had tuning pegs. Until about 1000 they were plucked; thereafter, bowing them was more common. Bowed lyres survived into the 20th century in Finland and Estonia. In Wales, the Croth, which had a fingerboard running from the crossbar to the body, was played into the 19th century.

However, a musician could not play very many notes on the Lyre in any of the previous forms, as they did not have frets. Therefore, upon the discovery of more advanced string instruments (i.e. Guitar, Violin, etc.) that had frets, Lyre became antiquated and obsolete and eventually forgotten. Today, only a few renovated models and some pictures of the traditional Lyre are displayed in museums in Germany and England. Also, certain African Lyres are still used for choral songs, magic, witchcraft, or curative purposes.

Today, there is a need in the art for an instrument that has the artistic beauty of a Lyre, yet able to produce a vast range of notes. The present invention, Tarpin, resembles a Lyre in its artistic form and shape, while it enables a musician to play all European and international scales, including melodies in the form of polyphonic and homophonic along with harmony. Tarpin is superior to all other string instruments in the prior art, in that a musician can play an enormous range of notes on eleven (11) strings, with very limited movement of one hand over the fret, while most other instrument require the musician to move his hand along the neck of the instrument. On an eleven (11) string Tarpin, a musician can play up to four and half octaves, with hardly any movement of a hand over the frets. Although, Tarpin is exceptionally simple to play, it can achieve all melodies, chords, and arpeggios along with harmony. There are many chords in many inversions that can only be played on Tarpin. In the preferred embodiment of the present invention, Tarpin has five (5) frets and eleven (11) strings. In its preferred embodiment, Tarpin has a tuning box that makes it possible for a performer to easily and quickly tune the instrument with the use of an Allen wrench. Tarpin is an ideal instrument that looks and sounds divine. It is truly a gift to the world of art and music.

SUMMARY

The present invention is a string musical instrument having a body with a hole in the center for sound resonance, an upper bridge at the top and a lower bridge at the bottom. There is a plurality of long frets connected with the top of the body directly below the upper bridge whereby the frets are distanced so as to produce sounds that are a half note apart. There is also a plurality of tuning boxes attached to the bottom of the body, which are used to tune the instrument. There is further a plurality of strings, running through the upper and lower bridge secured from the top on the back of the body and from the bottom to the tuning box. A performer holds the instrument with the bottom on his lap and places one hand on the top over the upper bridge with fingers projected over the frets to change the pitch and with the fingers of the other free hand plucks the string to produce music.

The apparatus may be produced as a stand-alone device, or it may be integrated with an amplifier and a speaker to amplify the sound.

In a further embodiment, the apparatus further includes two long necks projecting outwards from both sides of the body resembling a traditional Lyre.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1A:
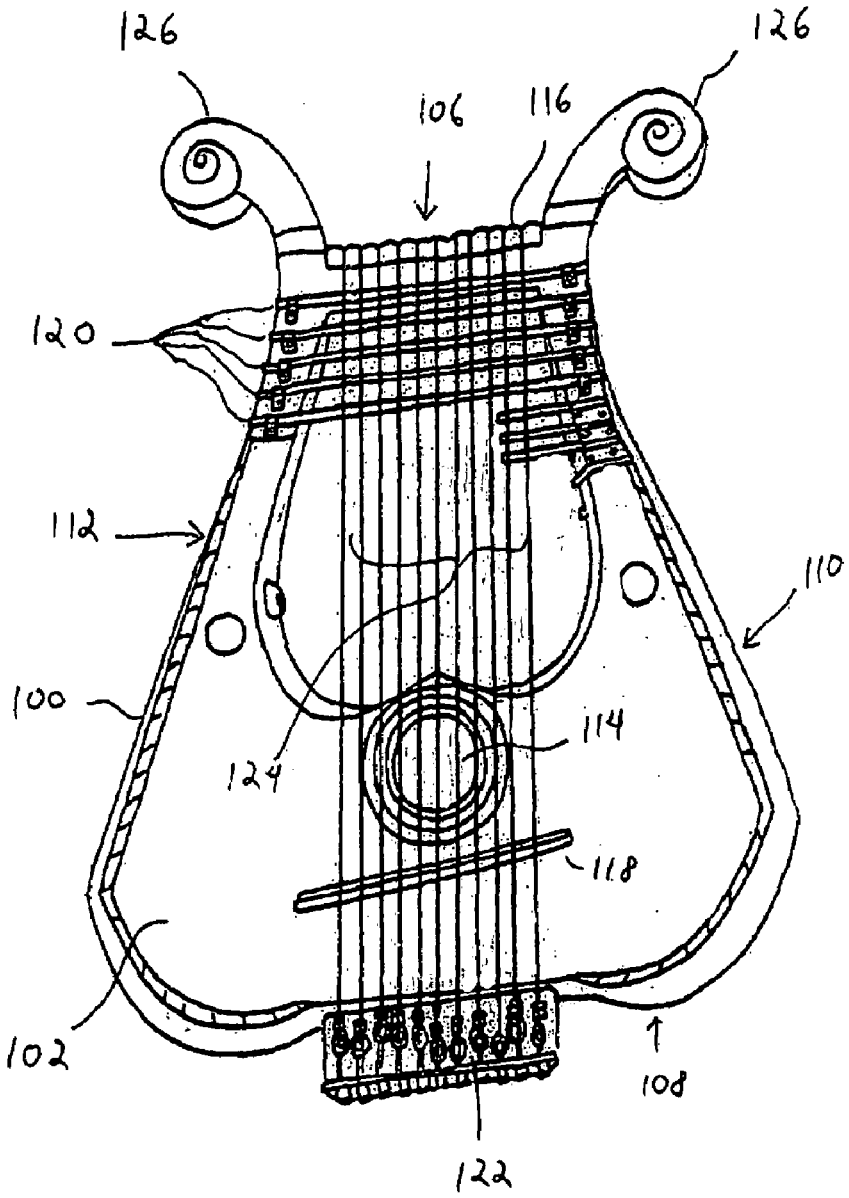
FIGS. 1A–1D are pictorial representations of front, side, and back of a Tarpin according to the present invention.
Figure 1B:
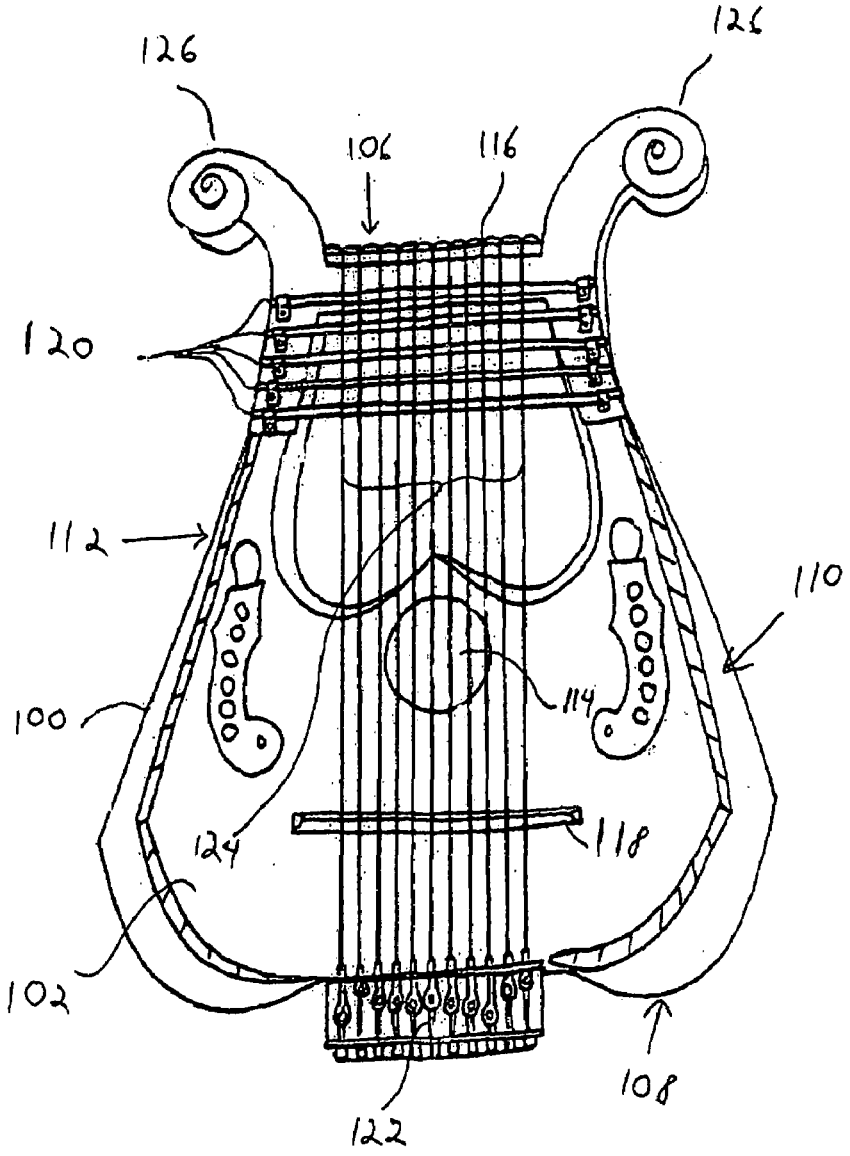
Figure 1C:
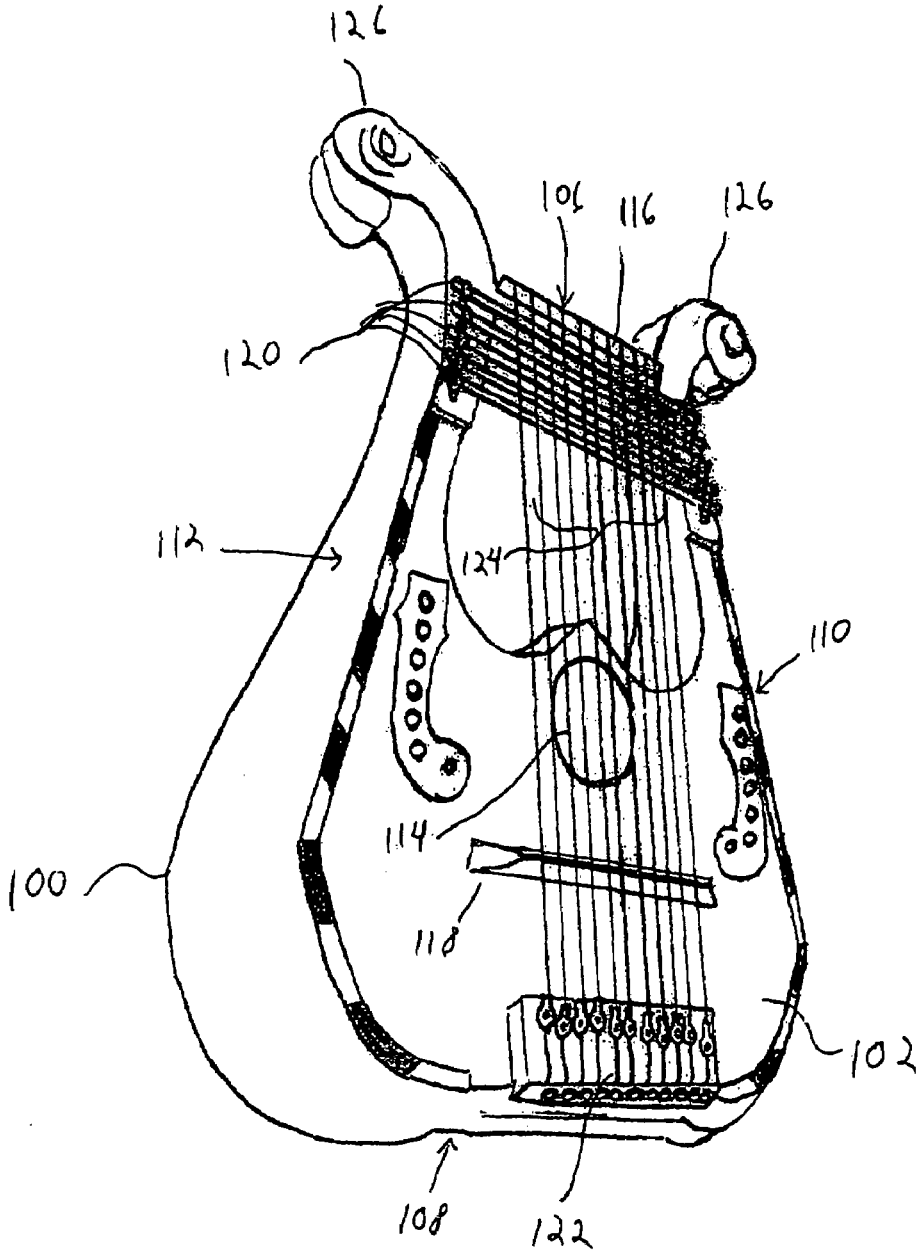
Figure 1D:
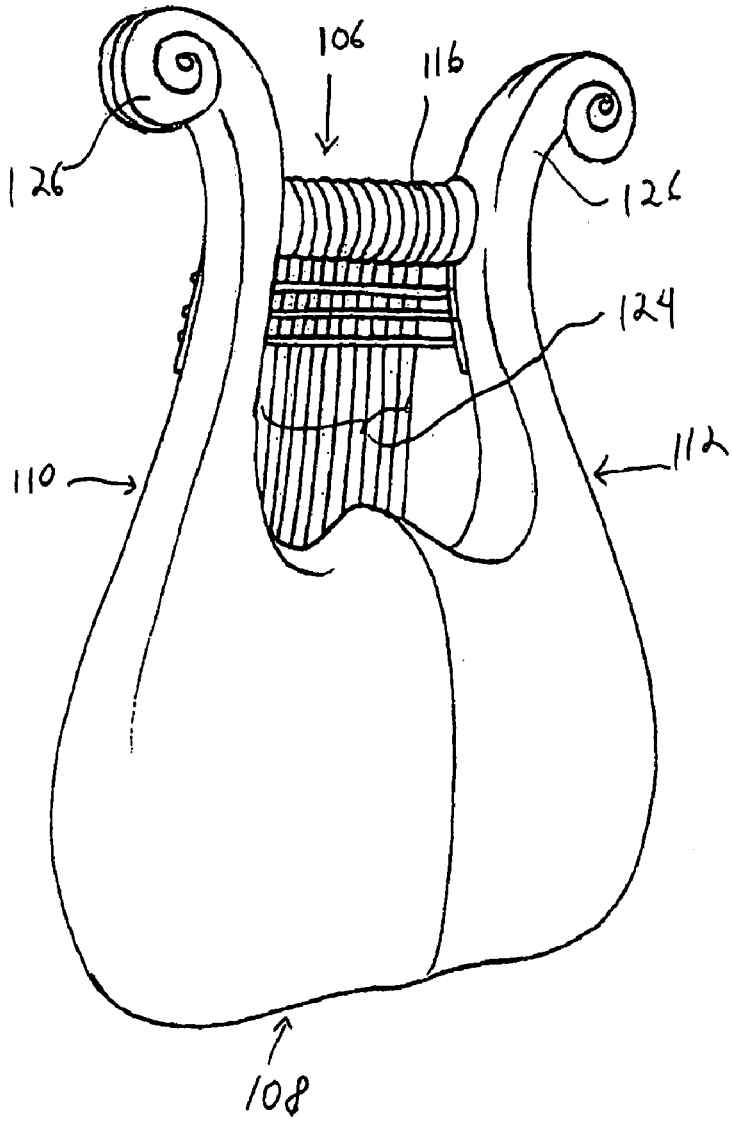

The present invention relates to the field of musical instruments, and more particularly to Tarpin, a string musical instrument. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In order to provide a working frame of reference, first a glossary of some of the terms used in the description and claims is given as a central resource for the reader. The glossary is intended to provide the reader with a "feel" for various terms as they are used in this disclosure, but is not intended to limit the scope of these terms. Rather, the scope of the terms is intended to be construed with reference to this disclosure as a whole and with respect to the claims below. Then, a brief introduction is provided in the form of a narrative description of the present invention to give a conceptual understanding prior to developing the specific details.

(1) Glossary

Before describing the specific details of the present invention, it is useful to provide a centralized location for various terms used herein and in the claims. The terms defined are as follows:

Amplifier—Amplifier is intended to be an electronic amplifier or any electronic means for amplification of sound.

Fret—Bars that designate certain spaces on the string for finger placement. The distance between the frets determines the variation of the pitch.

Speaker—Speaker is intended to include any means for converting electrical signals to sounds.

String—Any pliable string, metal or plastic used for guitar or other instruments.

Tarpin—The string musical instrument of the present invention.

(2) Introduction

The present invention is a string musical instrument having a body with a hole in the center for sound resonance, an upper bridge at the top and a lower bridge at the bottom. There is a plurality of long frets connected with the top of the body directly below the upper bridge whereby the frets are distanced so as to produce sounds that are a half note apart. There is also a plurality of tuning boxes attached to the bottom of the body, which are used to tune the instrument. There is further a plurality of strings, running through the upper and lower bridge secured from the top on the back of the body and from the bottom to the tuning box. A performer holds the instrument with the bottom on his lap and places one hand on the top over the upper bridge with fingers projected over the frets to change the pitch and with the fingers of the other free hand plucks the string to produce music.

(3) Discussion

FIGS. 1A–1D are pictorial representations of front, side, and back of a Tarpin according to the present invention. Tarpin comprises a hollow body 100 or resonance chamber having a front 102, a back 104, a top 106, a bottom 108, a left side 110, a right side 112, and a hole 114 in the center of the front 102 for sound resonance. An upper bridge 116 is connected to the top 106 of the body 100 and horizontal to the length of the body 100. A lower bridge 118 is attached to the front 102 near the bottom 108 of the body 100 and horizontal to the length of the body 100 and parallel to the upper bridge 116. A plurality of long frets 120 are connected with the top 106 of the body 100 and running horizontally along the length of the body 100 and parallel to the upper 116 and lower bridge 118, directly below the upper bridge 116 whereby the long frets 120 are distanced so as to produce sounds that are a half note apart. A plurality of tuning boxes 122 is attached to the bottom 108 of the body 100. A plurality of strings 124, equal in number to the tuning boxes 122, is connected with the body 100 and running vertically along the length of the body 100 from the top 106 to the bottom 108 running through the upper bridge 116 and lower bridge 118 and perpendicular to the long frets 120.

In the preferred embodiment of the present invention, Tarpin has eleven (11) strings 124, which are tuned according to the eleven (11) lines of a musical staff with five (5) lines in the treble clef, five (5) lines in the base clef, and one middle leger line, as the middle C, totaling eleven (11) strings 124.

In the preferred embodiment of the present invention, Tarpin, the body 100 has two necks 126 on the left side 110 and the right side 112 of the body 100 extending upwards and away from one another twirling inwards to resemble a traditional Lyre. In this embodiment, the two necks 126 extend upward starting from a point along the body below the upper bridge 116 creating an empty space between the body 100, the upper bridge 116, and the two necks 126 whereby the necks 126 are connected to one another in the bottom by the body 100 and in the top by the upper bridge 116 and the long frets 120 are connected to the two necks 126 on both sides.

Figure 2A:
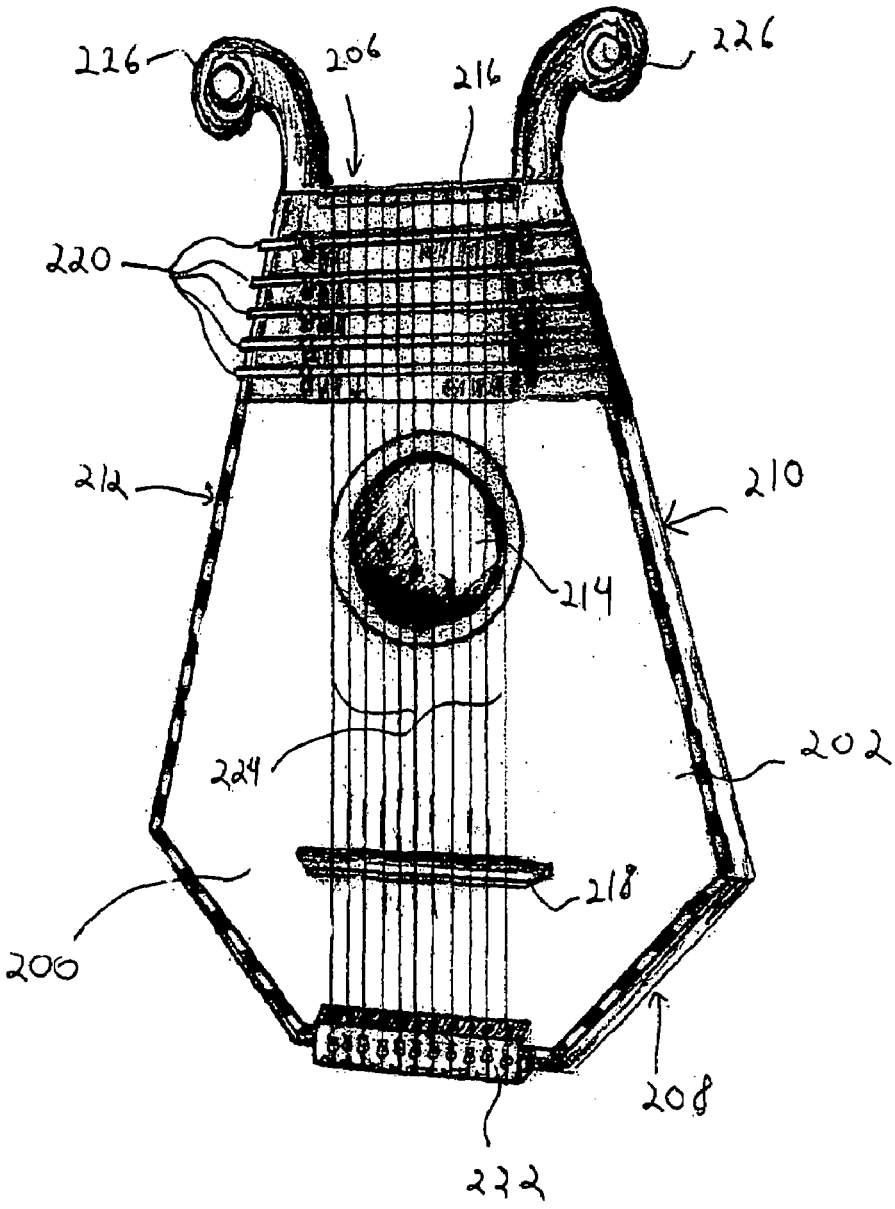
FIGS. 2A–2C are pictorial representations of front, side, and back of another embodiment of a Tarpin according to the present invention.
Figure 2B:
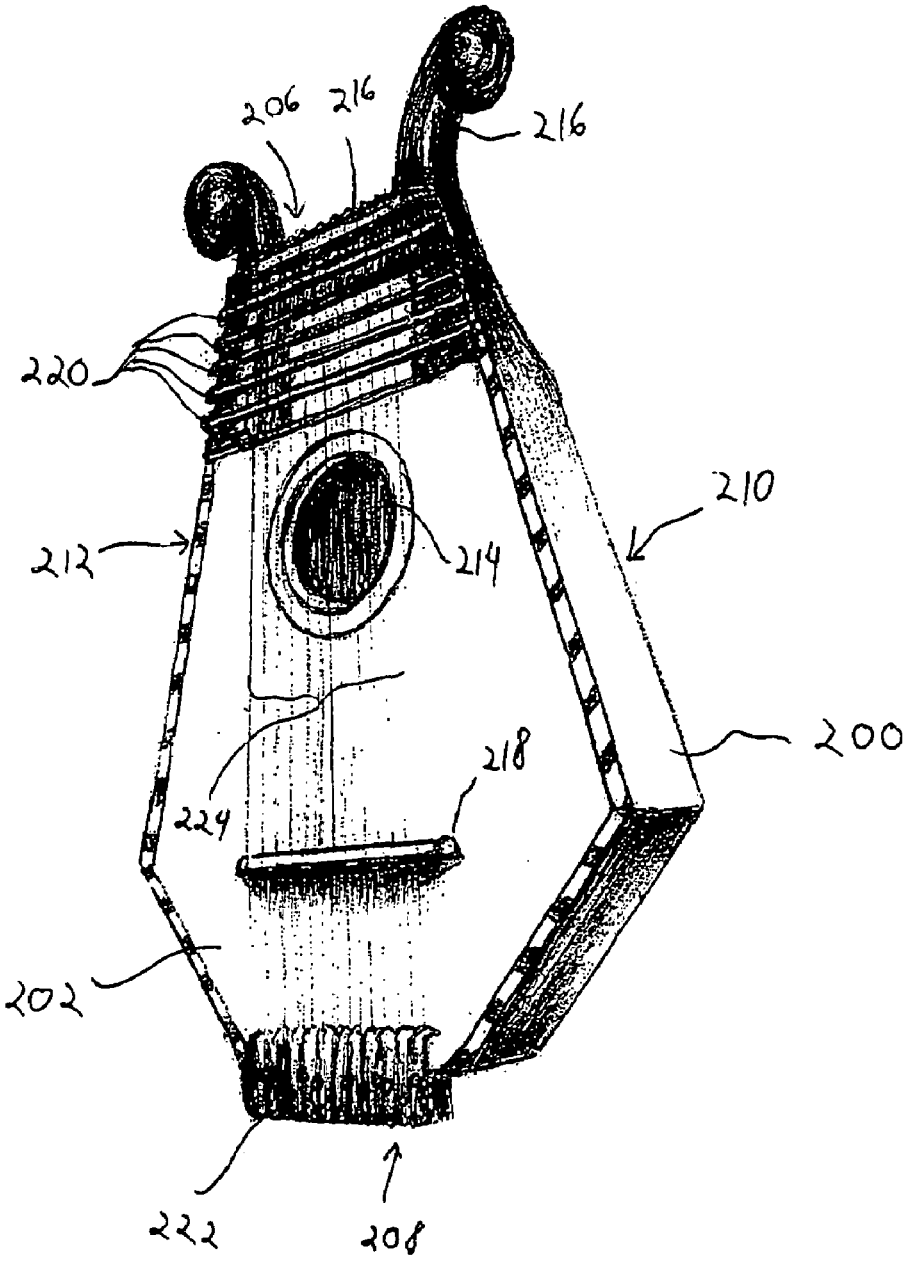
Figure 2C:
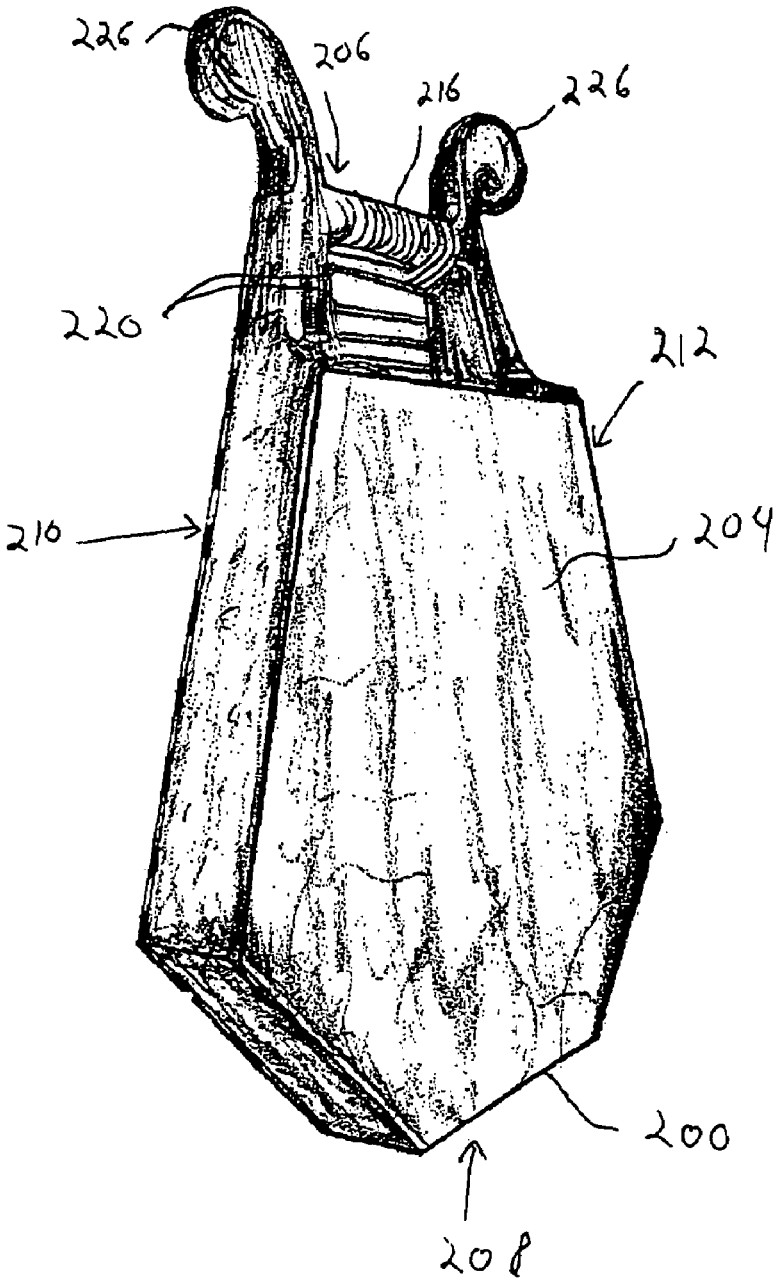
Figure 3A:
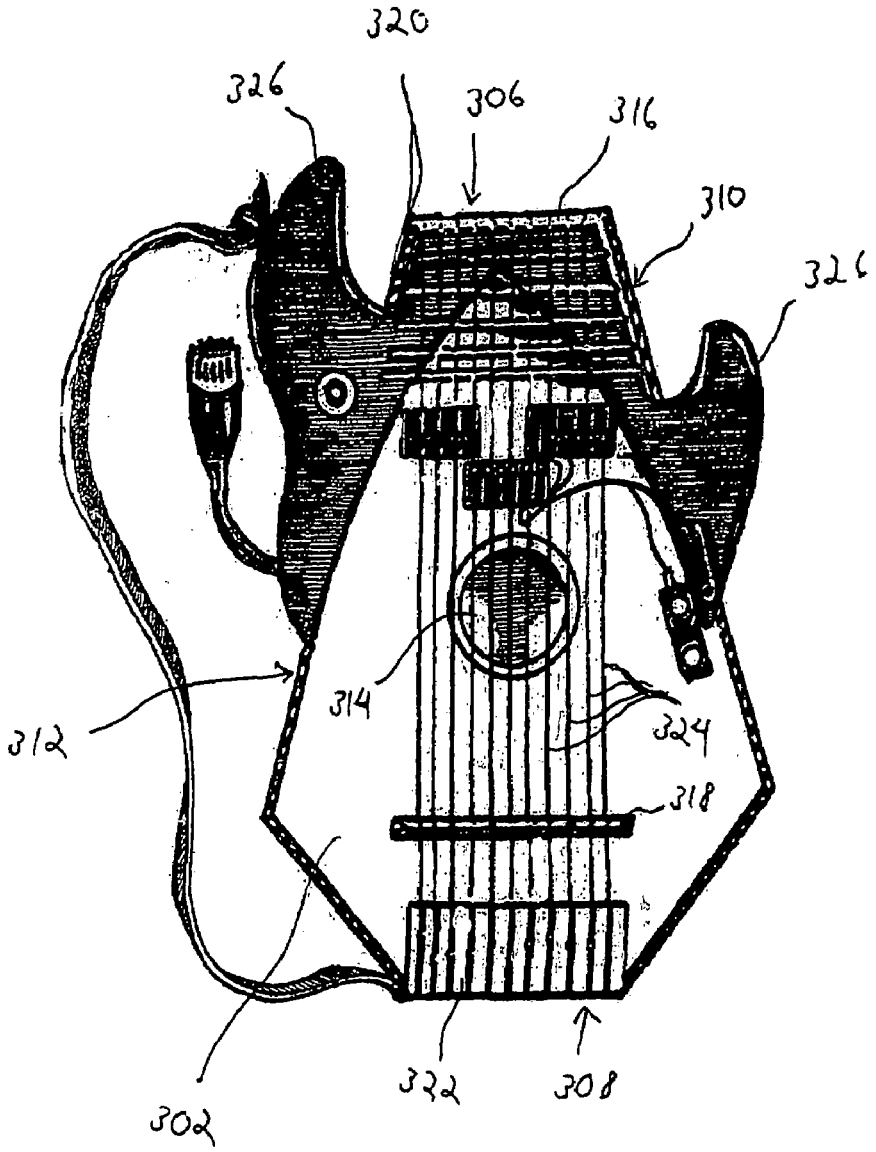
FIGS. 3A–3D are pictorial representations of yet another embodiment of front, side, and back of a Tarpin according to the present invention.
Figure 3B:
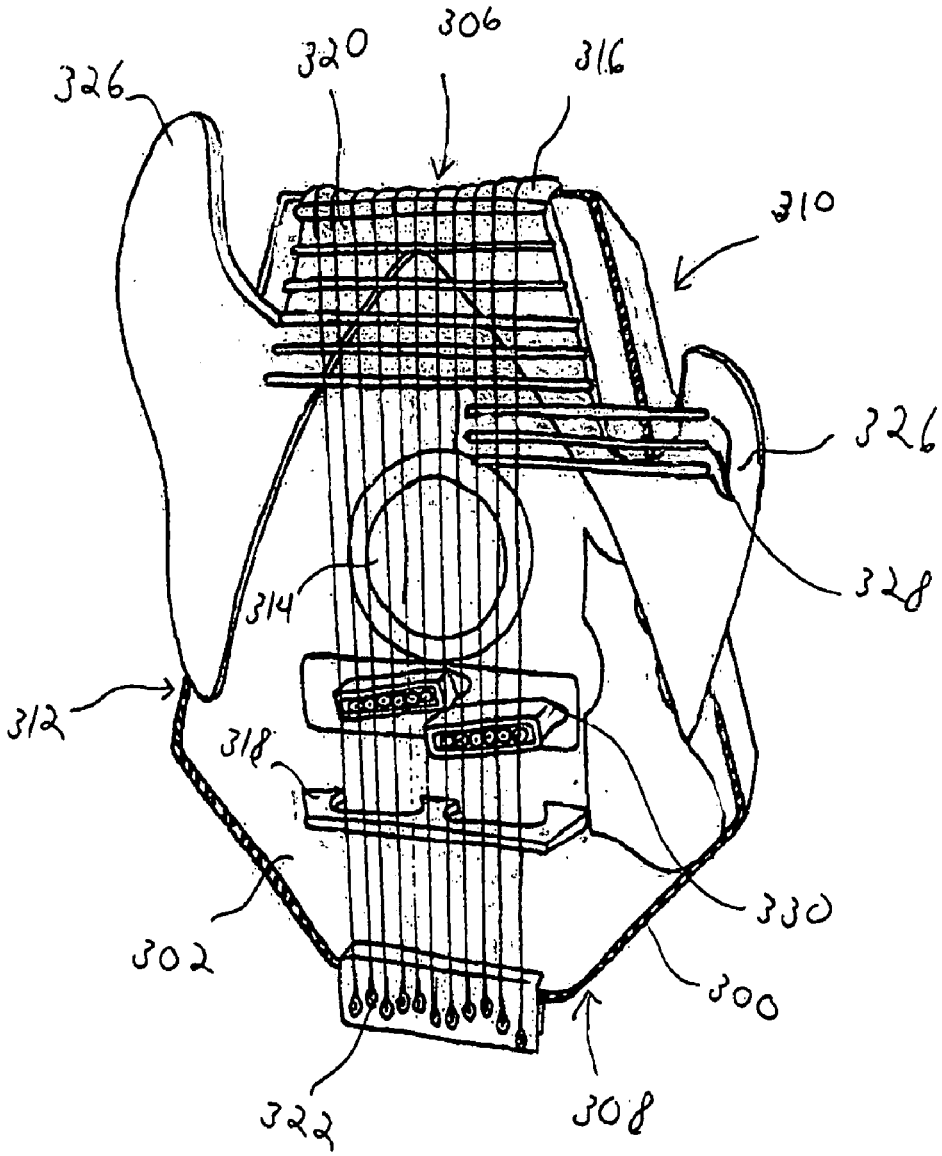
Figure 3C:
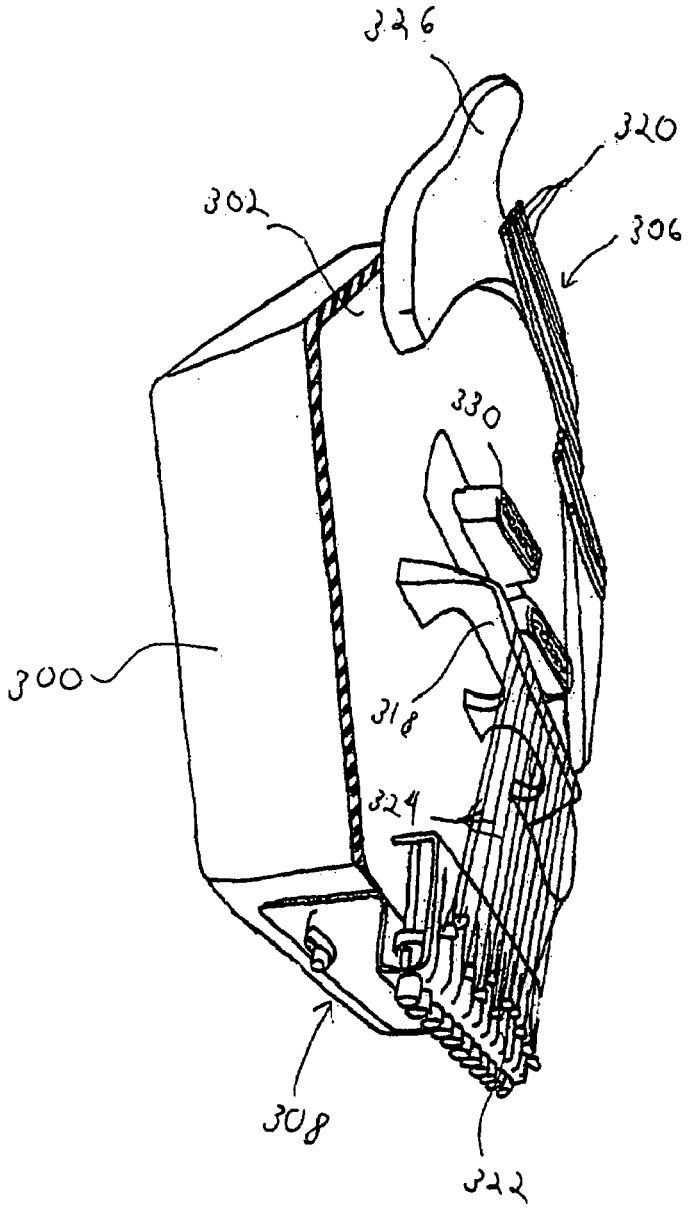
Figure 3D:
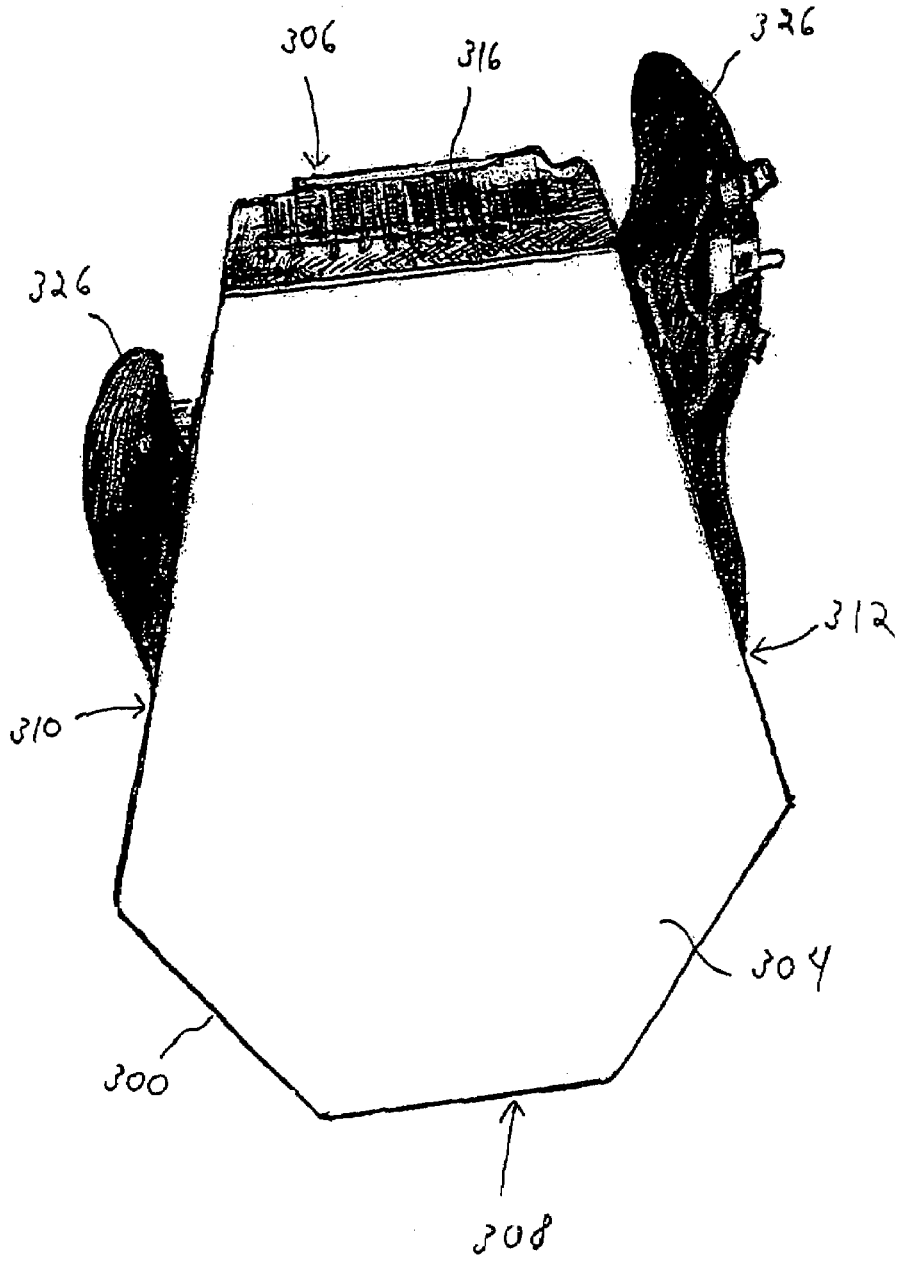

FIGS. 2A–2C are pictorial representations of front, side, and back of another embodiment of a Tarpin according to the present invention. In this embodiment, Tarpin comprises a hollow body 200 or resonance chamber having a front 202, a back 204, a top 206, a bottom 208, a left side 210, a right side 212, and a hole 214 in the center of the front 202 for sound resonance. An upper bridge 216 is connected to the top 206 of the body 200 and horizontal to the length of the body 200. A lower bridge 218 is attached to the front 202 near the bottom 208 of the body 200 and horizontal to the length of the body 200 and parallel to the upper bridge 216. A plurality of long frets 220 are connected with the top 206 of the body 200 and running horizontally along the length of the body 200 and parallel to the upper 216 and lower bridge 218, directly below the upper bridge 216 whereby the long frets 220 are distanced so as to produce sounds that are a half note apart. A plurality of tuning boxes 222 is attached to the bottom 208 of the body 200. A plurality of strings 224, equal in number to the tuning boxes 222, is connected with the body 200 and running vertically along the length of the body 200 from the top 206 to the bottom 208 running through the upper 216 bridge and lower bridge 218 and perpendicular to the long frets 220.

In this embodiment of the present invention also, Tarpin has eleven (11) strings 224, which are tuned according to the eleven (11) lines of a musical staff with five (5) lines in the treble clef, five (5) lines in the base clef, and one middle leger line, as the middle C, totaling eleven (11) strings 224.

In this embodiment of the present invention, Tarpin, the body 200 has two necks 226 on the left side 210 and the right side 212 of the body 200 extending upwards and away from one another twirling inwards to resemble a traditional Lyre. In this embodiment, the two necks 226 extend upward starting from a point of the body 200 directly below the long frets 220, whereby the necks 226 are connected to one another by the upper bridge 216 and the long frets 220 are connected to the two necks 226 on both sides. In this embodiment, the body 200 is hexagonal in shape.

FIGS. 3A–3D are pictorial representations of yet another embodiment of front, side, and back of a Tarpin according to the present invention. In this embodiment, Tarpin comprises a hollow body 300 or resonance chamber having a front 302, a back 304, a top 306, a bottom 308, a left side 310, a right side 312, and a hole 314 in the center of the front 302 for sound resonance. An upper bridge 316 is connected to the top 306 of the body 300 and horizontal to the length of the body 300. A lower bridge 318 is attached to the front 302 near the bottom 308 of the body 300 and horizontal to the length of the body 300 and parallel to the upper bridge 316. A plurality of long frets 320 are connected with the top 306 of the body 300 and running horizontally along the length of the body 300 and parallel to the upper 316 and lower bridge 318, directly below the upper bridge 316 whereby the long frets 320 are distanced so as to produce sounds that are a half note apart. In this embodiment, a plurality of short frets 328 is connected to the body 300 immediately below the long frets 320 providing for a longer range of tonality enabling a performer to play higher notes. Furthermore, a plurality of tuning boxes 322 is attached to the bottom 308 of the body 300. A plurality of strings 324, equal in number to the tuning boxes 322, is connected with the body 300 and running vertically along the length of the body 300 from the top 306 to the bottom 308 running through the upper 316 bridge and lower bridge 318 and perpendicular to the long frets 320.

In this embodiment of the present invention also, Tarpin has eleven (11) strings 324, which are tuned according to the eleven (11) lines of a musical staff with five (5) lines in the treble clef, five (5) lines in the base clef, and one middle leger line, as the middle C, totaling eleven (11) strings 324.

In this embodiment of the present invention, Tarpin, the body 300 has two necks 326 on the left side 310 and the right side 312 of the body 300 extending upwards asymmetrically. In this embodiment, the two necks 326 extend upward starting from a point along the body 300.

In this embodiment of the present invention, an amplifier 330 is connected to the body 300 to receive a sound signal therefrom and to amplify the sound signal to generate an amplified signal such that the sounds are more audible.

Figure 4:
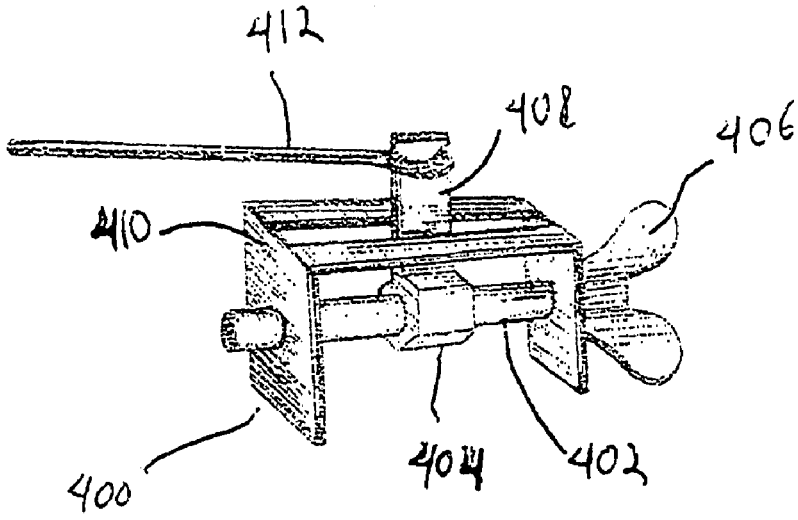
FIG. 4 is a pictorial representation of a tuning box of a Tarpin according to the present invention.

FIG. 4 is a pictorial representation of a tuning box of a Tarpin according to the present invention. The tuning box 400 is made of a bolt 402, a nut 404, a tailpiece 406, a clapper 408, and a grooved metal covering 410, wherein the clapper 408 is fixed on the nut 404 and placed in the groove of the metal covering 410. A string 412 is connected to the bolt 402 of the tuning box 400, wherein winding the bolt 402, will move the nut 404 and tune the string 412.

Figure 5:
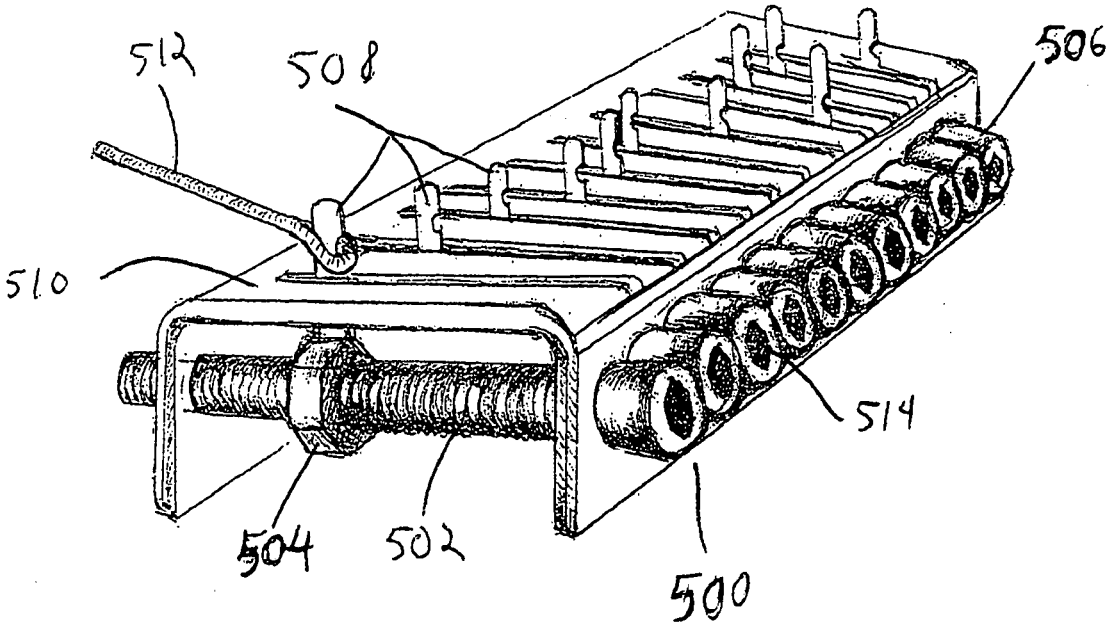
FIG. 5 is yet another pictorial representation of a tuning box of a Tarpin comprising holes for use by an Allen wrench according to the present invention.
Figure 5:
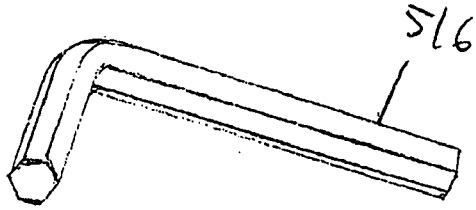

FIG. 5 is yet another pictorial representation of a tuning box of a Tarpin comprising holes for use by an Allen wrench according to the present invention. The tuning box 500 is made of a plurality of bolts 502, nuts 504, tailpieces 506, clappers 508, and a grooved metal covering 510, wherein the clappers 508 are fixed on the nut 504 and placed in the groove of the metal covering 510. A string 512 is connected to the bolt 502 of the tuning box 500, wherein winding the bolt 502, will move the nut 504 and tune the string 512. At the tuning box 500 of the preferred embodiment of the present invention, the bolt 502 is associated with holes 514 tailored for use by an Allen wrench 516.

Figure 6:
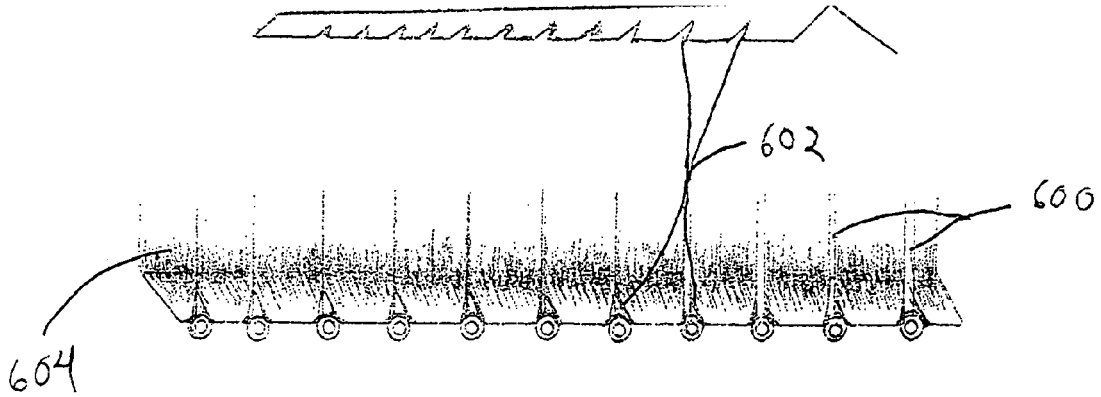
FIG. 6 is a pictorial representation of the back of an upper bridge of a Tarpin comprising indentations for securing a guitar string according to the present invention.

FIG. 6 is a pictorial representation of the back of an upper bridge of a Tarpin comprising indentations for securing a guitar string according to the present invention. In the preferred embodiment of the present invention, the strings 600 are secured from the top on the back of the body by indentations 602 in the back of the upper bridge 604.

Figure 7:
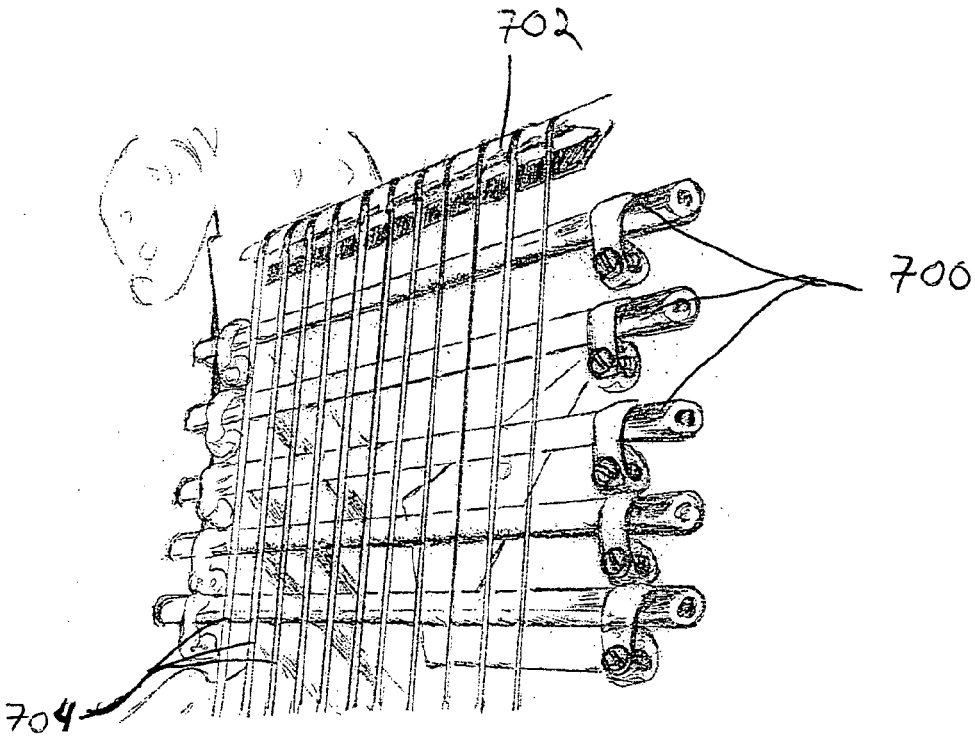
FIG. 7 is a pictorial representation of the long frets of a Tarpin according to the present invention.

FIG. 7 is a pictorial representation of the long frets of a Tarpin according to the present invention. A plurality of long frets 700 are connected to the body below the upper bridge 702, whereby strings 704 are positioned perpendicular to the long frets 700.

What is claimed is:

1. Tarpin, a string musical instrument comprising:

a. a body having a front, a back, a top, a bottom, a left side, a right side, and a hole in the center of the front for sound resonance;

b. an upper bridge at the top of the body and horizontal to the length of the body;

c. a lower bridge near the bottom of the body attached on the front of the body and horizontal to the length of the body and parallel to the upper bridge;

d. plurality of long frets connected with the top of the body and running horizontally along the length of the body and parallel to the upper and lower bridge, directly below the upper bridge whereby the long frets are distanced so as to produce sounds that are a half note apart;

e. plurality of tuning boxes attached to the bottom of the body, made of a bolt, a nut, a tailpiece, a clapper, and a grooved metal covering, wherein the clapper is fixed on the nut and placed in the groove of the metal covering; and f. plurality of strings, equal in number to the tuning boxes, connected with the body and running vertically along the length of the body from the top to the bottom running through the upper bridge and lower bridge and perpendicular to the long frets secured from the top on the back of the body by indentation in the back of the upper bridge and from the bottom on the bottom of the body connected to the bolt of the tuning box, wherein winding the bolt, will move the nut and tune the string;

whereby a performer holds the body with the bottom on his lap and places one hand on the top over the upper bridge with fingers projected over the frets to change the pitch and with the fingers of the other free hand plucks the string to produce music.

2. An apparatus for playing Tarpin, a string music instrument, as set forth in claim 1, whereby the strings are tuned according to the eleven (11) lines of a musical staff with five (5) lines in the treble clef, five (5) lines in the base clef, and one middle leger line, as the middle C, totaling eleven (11) strings.

3. An apparatus for playing Tarpin, a string music instrument, as set forth in claim 2, whereby the bolt of the tuning box is associated with holes tailored for use by an Allen wrench.

4. An apparatus for playing Tarpin, a string music instrument, as set forth in claim 3, whereby a plurality of short frets are connected to the body immediately below the long frets providing for a longer range of tonality enabling a performer to play higher notes.

5. An apparatus for playing Tarpin, a string music instrument, as set forth in claim 4, whereby the body has two necks on the left side and the right side of the body extending upwards starting from a point along the bridge creating an empty space between the body, the upper bridge, and the two necks whereby the necks are connected to one another in the bottom by the body and in the top by the upper bridge and the long frets are connected to the two necks on both sides and away from one another twirling inwards to resemble a traditional Lyre.

6. An apparatus for playing Tarpin, a string music instrument, as set forth in claim 1, whereby the bolt of the tuning box is associated with holes tailored for use by an Allen wrench.

7. An apparatus for playing Tarpin, a string music instrument, as set forth in claim 6, whereby a plurality of short frets are connected to the body immediately below the long frets providing for a longer range of tonality enabling a performer to play higher notes.

8. An apparatus for playing Tarpin, a string music instrument, as set forth in claim 7, whereby the body has two necks on the left side and the right side of the body extending upwards starting from a point along the bridge creating an empty space between the body, the upper bridge, and the two necks whereby the necks are connected to one another in the bottom by the body and in the top by the upper bridge and the long frets are connected to the two necks on both sides and away from one another twirling inwards to resemble a traditional Lyre.

9. An apparatus for playing Tarpin, a string music instrument, as set forth in claim 1, whereby a plurality of short frets are connected to the body immediately below the long frets providing for a longer range of tonality enabling a performer to play higher notes.

10. An apparatus for playing Tarpin, a string music instrument, as set forth in claim 9, whereby the body has two necks on the left side and the right side of the body extending upwards starting from a point along the bridge creating an empty space between the body, the upper bridge, and the two necks whereby the necks are connected to one another in the bottom by the body and in the top by the upper bridge and the long frets are connected to the two necks on both sides and away from one another twirling inwards to resemble a traditional Lyre.

11. An apparatus for playing Tarpin, a string music instrument, as set forth in claim 1, whereby the body has two necks on the left side and the right side of the body extending upwards starting from a point along the bridge creating an empty space between the body, the upper bridge, and the two necks whereby the necks are connected to one another in the bottom by the body and in the top by the upper bridge and the long frets are connected to the two necks on both sides and away from one another twirling inwards to resemble a traditional Lyre.

12. An apparatus for playing Tarpin, a string music instrument, as set forth in claim 2, whereby a plurality of short frets are connected to the body immediately below the long frets providing for a longer range of tonality enabling a performer to play higher notes.

13. An apparatus for playing Tarpin, a string music instrument, as set forth in claim 12, whereby the body has two necks on the left side and the right side of the body extending upwards starting from a point along the bridge creating an empty space between the body, the upper bridge, and the two necks whereby the necks are connected to one another in the bottom by the body and in the top by the upper bridge and the long frets are connected to the two necks on both sides and away from one another twirling inwards to resemble a traditional Lyre.

14. An apparatus for playing Tarpin, a string music instrument, as set forth in claim 6, whereby the body has two necks on the left side and the right side of the body extending upwards starting from a point along the bridge creating an empty space between the body, the upper bridge, and the two necks whereby the necks are connected to one another in the bottom by the body and in the top by the upper bridge and the long frets are connected to the two necks on both sides and away from one another twirling inwards to resemble a traditional Lyre.

15. An apparatus for playing Tarpin, a string music instrument, as set forth in claim 3, whereby the body has two necks on the left side and the right side of the body extending upwards starting from a point along the bridge creating an empty space between the body, the upper bridge, and the two necks whereby the necks are connected to one another in the bottom by the body and in the top by the upper bridge and the long frets are connected to the two necks on both sides and away from one another twirling inwards to resemble a traditional Lyre.

16. An apparatus for playing Tarpin, a string music instrument, as set forth in claim 2, whereby the body has two necks on the left side and the right side of the body extending upwards starting from a point along the bridge creating an empty space between the body, the upper bridge, and the two necks whereby the necks are connected to one another in the bottom by the body and in the top by the upper bridge and the long frets are connected to the two necks on both sides and away from one another twirling inwards to resemble a traditional Lyre.

* * * * *